United States Patent [19]

Larsen

[11] 3,987,907

[45] Oct. 26, 1976

[54] ADJUSTABLE BRACKET ASSEMBLY FOR A RAIL CAR COUPLER

[75] Inventor: Glen D. Larsen, Upper Marlboro, Md.

[73] Assignee: Southern Railway Company, Washington, D.C.

[22] Filed: Apr. 29, 1975

[21] Appl. No.: 572,861

[52] U.S. Cl. ..... 213/61; 248/295

[51] Int. Cl.[2] ..... B61G 7/12

[58] Field of Search ..... 213/20, 21, 60, 61; 248/295, 287; 285/25, 26; 403/373

[56] References Cited

UNITED STATES PATENTS

| | | | |
|---|---|---|---|
| 1,007,997 | 11/1911 | Wendt | 213/61 |
| 1,661,592 | 3/1928 | Wright | 248/295 X |
| 2,863,570 | 12/1958 | Hicks | 213/60 |
| 2,894,646 | 7/1959 | Hicks | 213/61 X |
| 3,394,821 | 7/1968 | Cordani | 213/61 |

FOREIGN PATENTS OR APPLICATIONS

| | | | |
|---|---|---|---|
| 828,575 | 12/1969 | Canada | 213/20 |

*Primary Examiner*—Robert B. Reeves
*Assistant Examiner*—John P. Shannon
*Attorney, Agent, or Firm*—Watson, Cole, Grindle & Watson

[57] ABSTRACT

A rail car coupler, with the shaft thereof bearing against a coupler carrier, is adjusted vertically by means of serrated lock plates intermeshing with similarly serrated coupler carrier brackets. Vertically spaced fastener openings in the lock plates are so disposed relative to the teeth of the serrations thereof as to permit relative adjustment of the brackets equal to the size of a tooth of the serrations while the lock plates are in a first position. And the lock plates permit a fine adjustment of the brackets upon relative movement thereof equal to one-half the size of a tooth of the serrations when the lock plates in one embodiment are inverted 180° into a second position relative to the first position thereof. In another embodiment, such fine adjustment is effected as the brackets and the coupler carrier are inverted into a second position relative to a first position thereof. The lock plates in this embodiment are fixedly secured in place.

6 Claims, 9 Drawing Figures

16
17
18
21
23
26
28
29
37
39
46
47
48
49
51
a
b
c
10
10+
10-
13
16+
16-
2x
2y
x
y

ADJUSTABLE BRACKET ASSEMBLY FOR A RAIL CAR COUPLER

BACKGROUND OF THE INVENTION

1. Field of the Invention

This invention relates generally to an adjustable bracket of a bracket assembly, and more particularly to such an assembly provided for a rail car coupler for effecting vertical adjustment of the coupler carrier thereof.

2. Description of the Prior Art

In a typical rail car construction, the coupler extending outwardly of opposite ends thereof has a shaft extending along the centerline of the draft gear of the car, the shaft being mounted for longitudinal as well as vertical and transverse movement so as to permit continued interengagement during car travel with a like coupler of an adjacent car. Such coupler shaft typically rests on a transverse coupler carrier having a wear plate thereon so as to minimize wear. The coupler carrier is supported at opposite ends by carrier brackets which are normally fixedly mounted to side plates of the rail car.

The centerline of a freight car coupler is nominally set at 34½ inches above the rail. The Interchange Requirements of the Association of American Railroads presently require coupler heights for empty cars to be a minimum of 32½ inches and a maximum of 34½ inches measured from the top of the rail to the center of the face of the coupler knuckle. For loaded cars coupler heights of a minimum of 31½ inches and a maximum of 33½ inches are required and, where possible, adjustments are suggested to be made when the car is empty. This is a typical standard set for all freight cars by the AAR.

When it is desired to adjust the coupler height upwardly in order to comply with the above-noted coupler heights, due to excessive wear of the carrier member wear plate or because the standard coupler height was not maintained by the freight car manufacturer, shims are customarily inserted between the coupler carrier wear plate and the coupler shaft. These coupler carrier shims are required by the AAR to be of a minimum ¼ inch thickness, and may be flat, L-shaped or U-shaped in cross-section so that it may be slipped over the coupler carrier wear plate. The coupler must be elevated as by means of a jack or the like to its upper limit in order to carry out this standard procedure. The shim may then be installed beneath the coupler shaft and welded or otherwise secured in place over the wear plate.

The height of the rail car coupler may be adjusted by placing the coupler in the proper alignment with the draft gear of the car using one of the aforedescribed shims where necessary. If less than ¼ inch is required for the shim, realignment is not necessary. Also, where the coupler is in proper alignment and the minimum coupler height has not resulted, further adjustment must be made at the truck springs, center plates or journal boxes of the car. The truck spring shims must be of hardwood of not less than ⅝ inch thickness, or steel of not less than ¼ inch. On the other hand, when the coupler is in proper alignment and height, but is sagging by 1 inch or more, it must be adjusted by means of the shims as aforedescribed.

It is important to note that the coupler adjustments as described above provide only vertically upward adjustment but no vertically downward adjustment.

It has been found that vertically downward adjustment of the coupler height is oftentimes required especially for newly built rail cars. During the construction of such new cars, the extreme dimensional tolerances in wheels, truck side frames and bolsters, center plates and fabricated roll sections are accumulated to the extend that the coupler height becomes unpredictable. The car builders repeatedly strive to adhere to the AAR requirements set for the coupler height, but are not always successful. Oftentimes, newly built cars are delivered with a coupler height of 35½ inches. This creates much agony for the car builder and the railroad since the Federal Railroad Administration inspectors may very well condemn the car for the reason that the coupler height for the empty new car at 35½ inches and the loaded car at a minimum of 31½ inches would result in a 4 inch differential. Normal vertical oscillations of the car over the road could therefore cause the mated couplers between the cars to become disengaged.

Also, there is a trend toward the use of hardened wear plates located under the coupler shaft of expensive wear resistant steel such as cast manganese. Therefore, introduction of a mild steel shim would only destroy the wear potential of the manganese, or equivalent, coupler carrier wear plate.

The only known coupler height adjuster other than the use of shims is a trunnion hung device having rotated cam wheels at each side. This results in a swing hanger effect under the coupler which is oftentimes undesirable from the standpoint of effectiveness and safety.

SUMMARY OF THE INVENTION

It is an object of the present invention to provide a means for adjusting the height of the rail car coupler both vertically upwardly and vertically downwardly in a simple and efficient yet effective and highly economical manner so as to avoid the drawbacks heretofore used in coupler adjustment.

Another object is to provide such an adjustment means which makes use of an intermeshing engagement between serrated surfaces of the coupler carrier brackets and lock plates so as to assure against any slippage of the adjusted coupler while at the same time permitting fine coupler adjustment with likewise no slippage of the coupler carrier brackets.

Other objects, advantages and novel features of the invention will become more apparent from the detailed description of the invention when taken in conjunction with the accompanying drawings.

In summary, the coupler height is adjusted as the carrier member and its brackets are shifted vertically by means of an intermeshing engagement between serrated surfaces on the brackets and on lock plates engaged therewith. The brackets are retained in place on the side plates of the rail car by means of fasteners including bolts extending through vertically spaced and vertically elongated openings provided in the brackets. The bolts likewise extend through aligned openings provided in the wear plates. The brackets may therefore be adjusted vertically upwardly or downwardly a distance equal to the size of one of the teeth of the serrations while the lock plates are in a first position relative to the brackets.

The openings in the lock plates are so disposed that the axis of one of the bolts extending therethrough intersects with the apex of one of the teeth of the serrations, while the axis of another bolt extending therethrough intersects with the trough between a pair of adjacent teeth of the serrations thereof. Accordingly, the brackets are adjustable relative to the lock plates upwardly or downwardly a distance equal to at least one-half the size of the teeth of the serrations when the lock plates are inverted 180° relative to such first-mentioned position.

BRIEF DESCRIPTION OF THE DRAWINGS

FIGS. 5A, 5B and 5C are respectively side elevational views of the bracket shown vertically adjusted in FIG. 5B relative to that shown in FIG. 5A a distance equal to the size of one tooth of the serrated surfaces, while FIG. 5C shows the bracket adjusted relative to that shown in FIG. 5A a distance equal to one-half the size of such tooth;

FIG. 6 is a schematic illustration of the relative amounts the coupler is adjusted at its pulling face line versus that at the coupler carrier position;

DESCRIPTION OF THE PREFERRED EMBODIMENT

Figure 1:
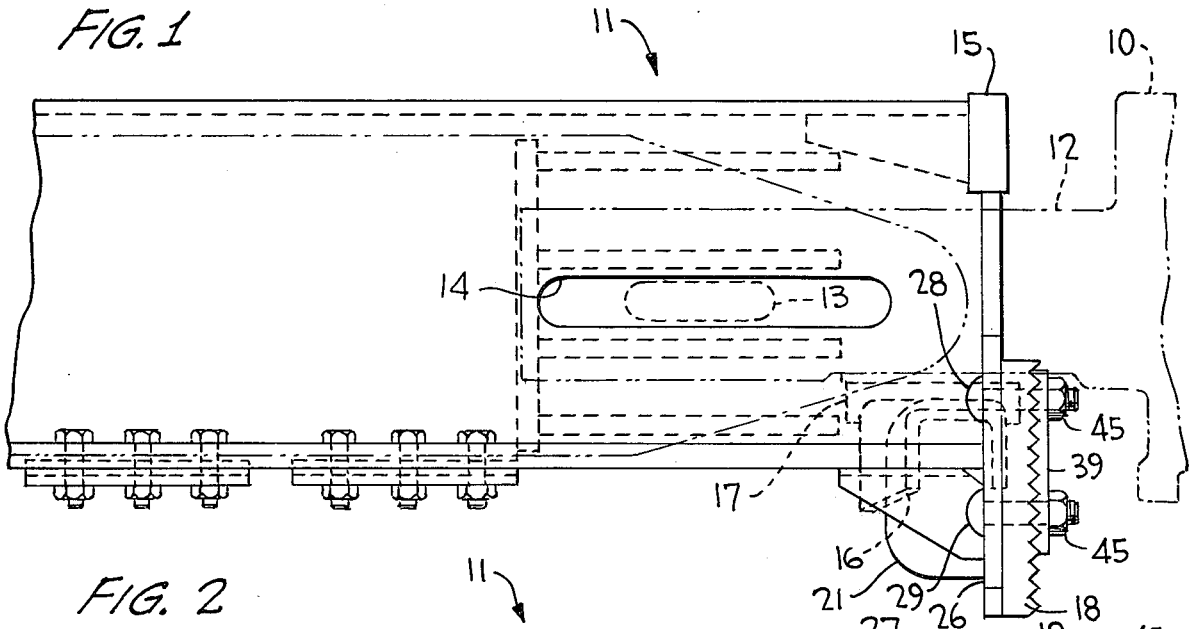
FIG. 1 is a side elevational view of the adjustable bracket assembly shown with a portion of a rail car on which it is used.
Figure 2:
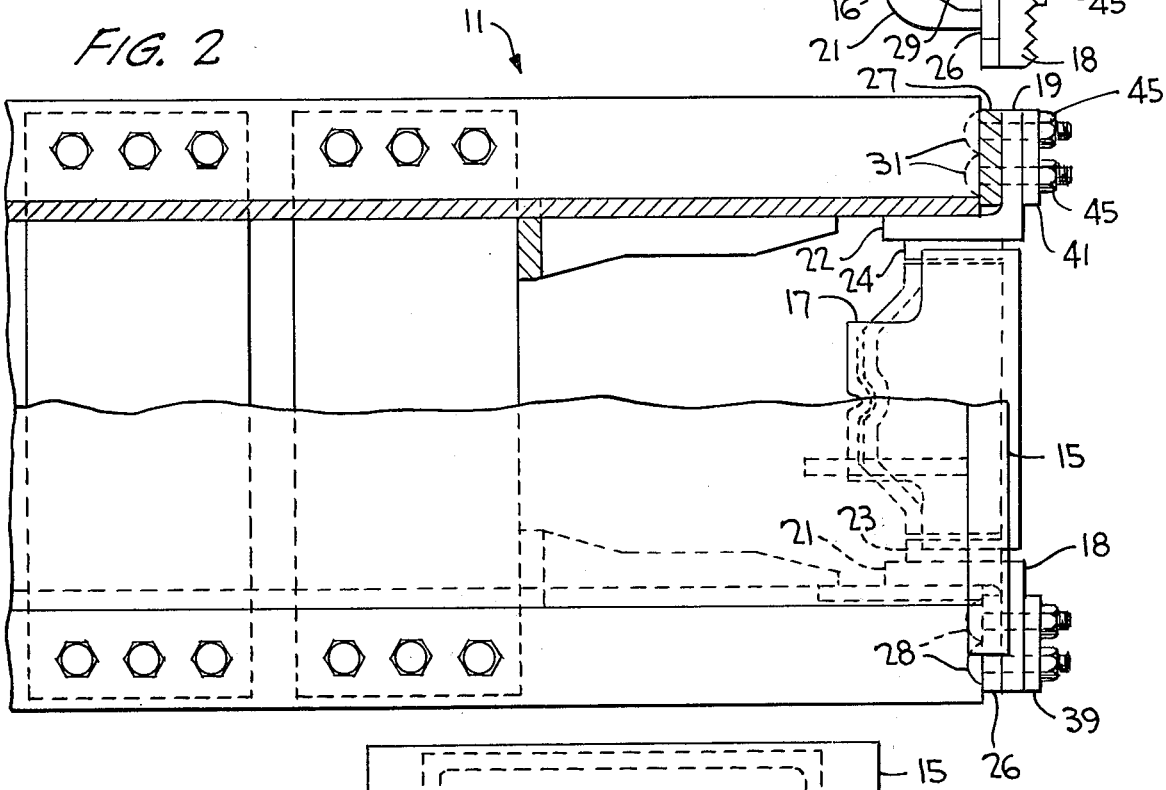
FIGS. 2 and 3 are respectively top plan and end elevational views of the construction shown in FIG. 1.
Figure 3:
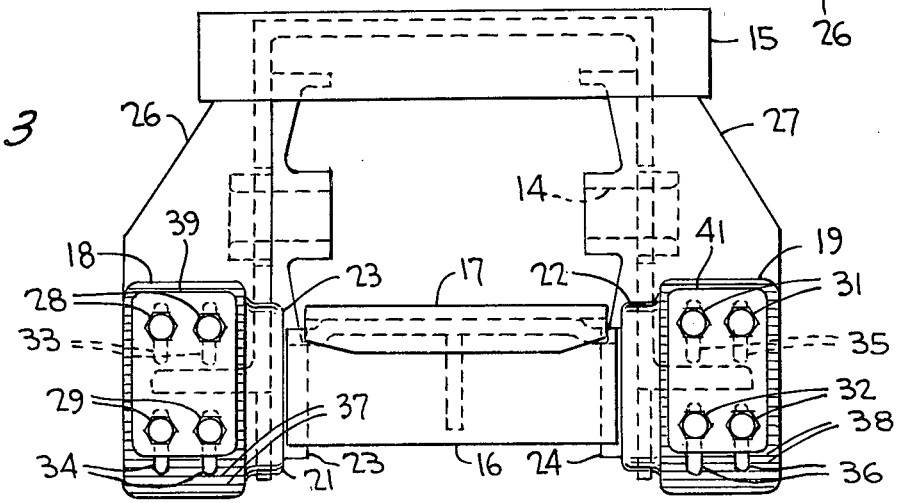

Turning now to the drawings wherein like reference characters refer to like and corresponding parts throughout the several views, the rail car coupler is shown in phantom outline at 10 in FIG. 1 which illustrates in side elevation a draft gear pocket 11 typically arranged at the lower side of the freight car which is not otherwise shown. The coupler has a conventional shaft 12 with transversely extending draft keys 13 guided within slots 14 for permitting slight longitudinal movement of the coupler which is cushioned in some customary manner by means located aft of the coupler shaft. A typical striker plate 15 is located above the coupler shaft thereby defining a top wall for the pocket through which the shaft extends outwardly of the rail car. The coupler shaft rests on a coupler carrier member 16 which spans beneath the coupler shaft, the carrier being covered by a wear plate 17 in the normal manner. Such a wear plate may be of manganese hardened steel.

The carrier member is supported at its opposite end by means of brackets 18 and 19 respectively having angled support elements 21 and 22 thereon. Such angled support elements are each provided with a boss 23 and 24 of a size slightly smaller than the inner dimension of carrier member 18 so that the carrier member may be fitted conveniently thereon as in the manner shown in the drawings. Each bracket may have a smooth rearward surface 25 which lies flatly against respective side plates 26 and 27 of the draft gear pocket arrangement 11. Bracket support means such as bolts 28 and 29 extend through suitably provided openings in side plate 26 for supporting bracket 18 thereon. Likewise, bracket securing means such as bolts 31 and 32 are provided in a similar manner for retaining bracket 19 on side plate 27.

A pair of vertically elongated openings 33 are provided in bracket 18 through which bolts 28 extend, while another pair of openings 34 are provided in this bracket through which bolts 29 extend. Likewise, bolts 32 extend through vertically elongated openings 35 provided in bracket 19, while bolts 31 extend through vertically elongated openings 36 located in bracket 19. It can be seen that openings 33 and 35 are also vertically spaced from their respective openings 34 and 36.

Figures 5A, 5B, 5C, 6:
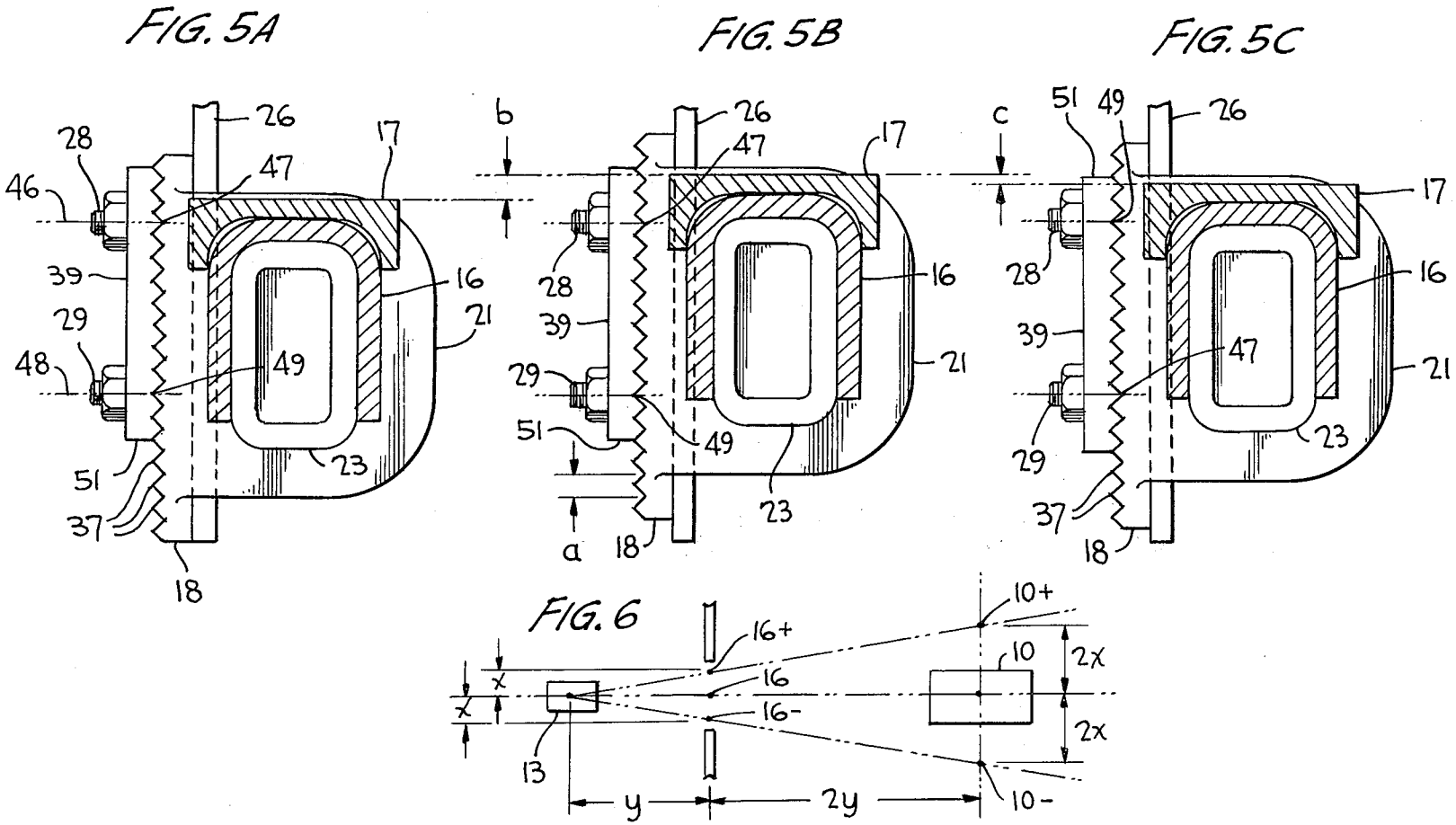

The front surface of bracket 18 is serrated so as to form a plurality of teeth 37 lying parallel to coupler carrier 16. The front face of bracket 19 is similarly serrated to form teeth 38. The teeth in the front faces of both brackets are of an equal predetermined size as for example ½ inch so that $a = ½$ inch as shown in FIG. 5B.

Lock plates 39 and 41 are provided in accordance with the invention for effecting vertical adjustment of the brackets. Plate 39 is provided with a pair of openings 42 through which bolts 28 extend, and another pair of openings 43 is provided through which bolts 29 extend. Similar openings are provided (not shown for clarity) in lock plate 41 through which bolts 31 and 32 extend. Also, the rearward face of each lock plate is serrated so as to form teeth 44 of the same size and disposition as that of the teeth provided on the brackets.

The brackets are supported on the side plates by means of the bolts which extend through the respective openings in the side plates, brackets and lock plates, and the brackets are held in place by means of nuts 45 which threadedly engage with the bolts. Of course, lock nuts or the like can be alternately provided for retaining the brackets in place, and elongated retaining means other than the bolts can be provided if desired.

The brackets, and the coupler carrier which they support, are maintained at the prescribed elevation from the top of the rail by means of the intermeshing engagement between the lock plate teeth and the bracket teeth. By reason of the elongated openings in the brackets, they may be adjusted vertically upwardly or vertically downwardly by simply loosening nuts 45 so as to disengage the lock plate teeth from the bracket teeth whereafter the brackets may be disposed at the required elevation and locked in place as the nuts are tightened on the bolts. The intermeshing engagement between the lock plates and the bracket teeth avoids any slippage of the vertically adjusted coupler carrier and brackets relative to the lock plates or to the side plates.

Referring specifically to FIGS. 5A and 5B, it can be seen that bracket members together with the coupler carrier can be adjusted vertically a minimum distance of $b = ½$ inch since the size of each of the intermeshing teeth is equal to ½ inch. FIG. 5B illustrates one of the brackets 18 as having been adjusted vertically upwardly a distance $b$ relative to the elevation of the bracket and the carrier member shown in FIG. 5A. Of course, the brackets and carrier member may be likewise adjusted vertically downwardly a minimum distance of $b = ½$inch in the same manner.

Figure 4:
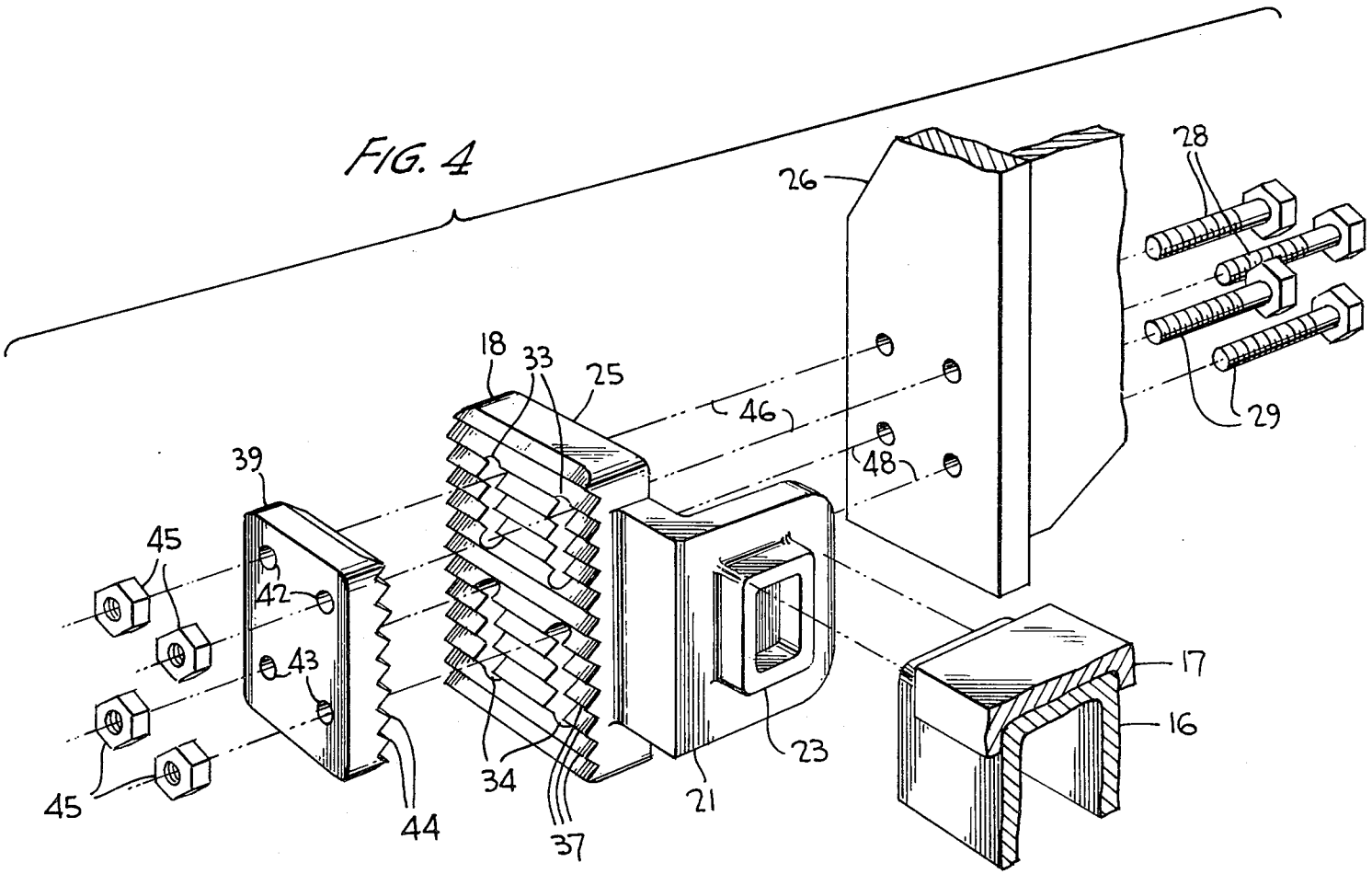
FIG. 4 is an expanded perspective view of the adjustable bracket assembly in accordance with the present invention.

With particular reference to FIGS. 4 and 5, it can be seen that axes 46 of bolts 28, and likewise the central aligned axes of openings 42 in lock plate 39, intersect with an apex 47 of one of the lock plate teeth. On the other hand, axes 48 of bolts 29, which are likewise the axes of openings 43 of lock plate 49, intersect with the trough 49 or lowermost portion between a pair of adjacent teeth of the lock plate. Therefore, by inverting the lock plate so that its end wall 51 is uppermost in FIG. 5C (compare FIGS. 5A and 5B), bracket 18 may be adjusted vertically a distance *c* equal to ¼ inch which is one-half the size *a* of one of the teeth. With such an arrangement, openings 42 of lock plate 39 are now lowermost and openings 43 thereof are now uppermost. And, by reason of the particular disposition of these openings relative to the lock plate teeth as aforedescribed, a minimum vertical adjustment of one-half the size of a tooth (in this case a distance of ¼ inch) is made possible for bracket 18 relative to a reference plane as illustrated in FIGS. 5B and 5C. Naturally, such fine vertical adjustment may be made either upwardly or downwardly the same minimum distance relative to a reference plane. The above description concerning the fine adjustment made possible by simply inverting lock plate 39 applied equally well for lock plate 41 so that both brackets may be adjusted together with a coupler carrier throughout the same minimum distance *b* with the lock plate in its upright position thereof, and throughout a minimum distance *c* when the lock plates are in their inverted positions of FIG. 5C.

The need for a fine adjustment of the coupler carrier, as aforedescribed, is important because every increment of adjustment made at the coupler carrier location is essentially doubled at the pulling face line of coupler 10 at which the elevation from the top of the rail is measured. Such is illustrated schematically in FIG. 6 wherein it is shown that the distance $2y$ between the coupler carrier and the pulling face of the coupler is approximately double the distance $y$ between the coupler carrier and key 13 at which the coupler and its shaft is essentially pivoted. Therefore, distance $x$ between 16 and 16+ or between 16 and 16− is doubled to $2x$ between location 10 of the coupler and its adjusted location 10+ or 10−. Therefore, when $x = ¼$inch, $2x =$ ½inch at the pulling face of the coupler.

From the foregoing, it can be seen that a bracket assembly has been devised in such a manner that the coupler carrier can be finely adjusted vertically by means of intermeshing and interlocking toothed serrations provided on the brackets and the lock plates without sacrificing the locking quality of the intermeshing teeth. For example, the brackets and lock plates are preferably of shell-molded cast steel for economical and other business purposes. Even with this precision process used for manufacturing such parts, large teeth of a size such as ½ inch are required to obviate the need for machining which would only be uneconomical. In accordance with the invention the coupler carrier may be adjusted vertically a distance equal to ¼ inch despite the fact that the teeth of the intermeshing serrations are ½ inch in size. Otherwise, the brackets and lock plates would need to be cast with teeth of a ¼ inch size which would be impractical from a cast manufacturing standpoint.

Figure 7:
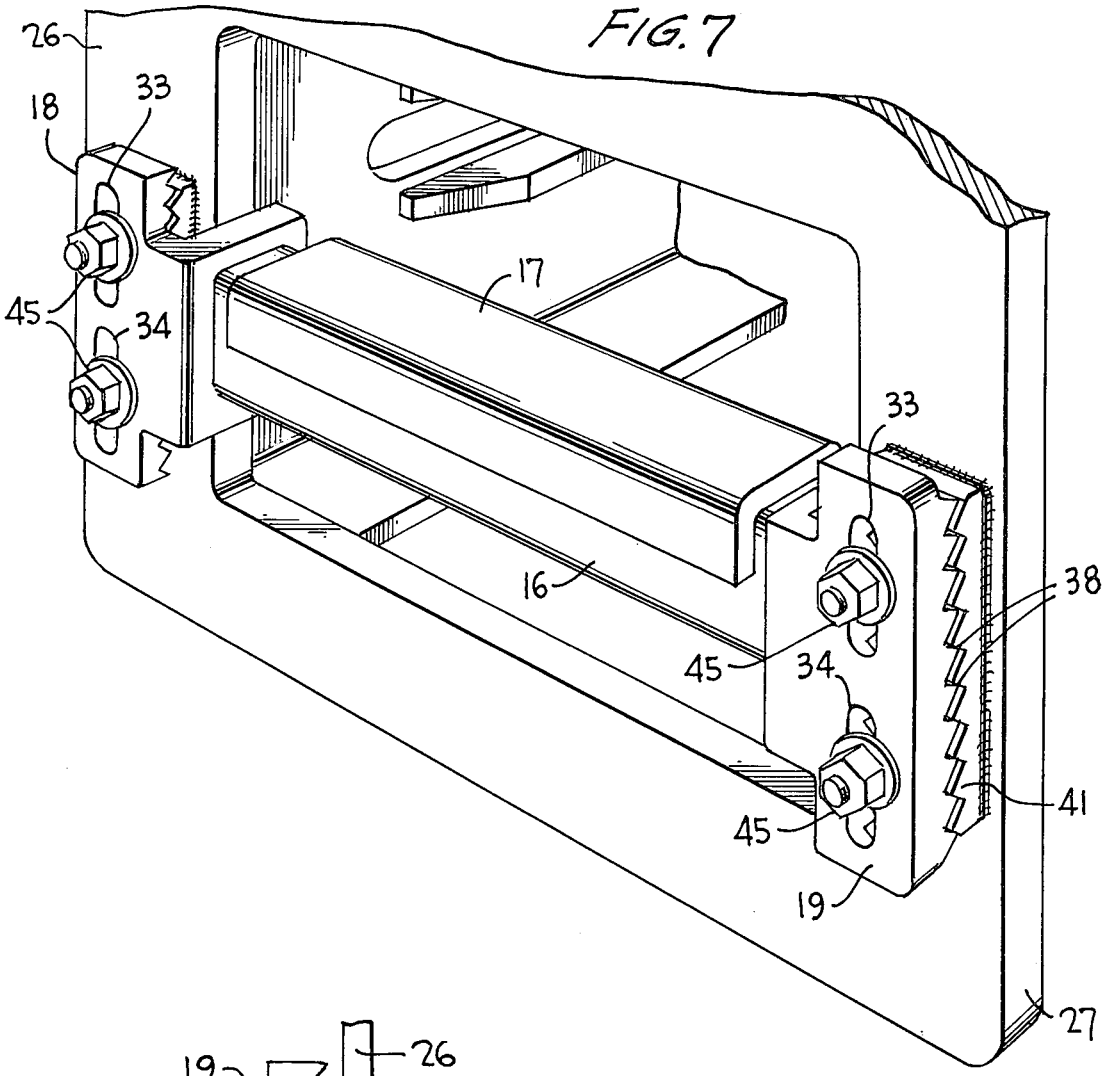
FIG. 7 is a perspective view of another embodiment of a bracket assembly according to the invention.
Figure 8:
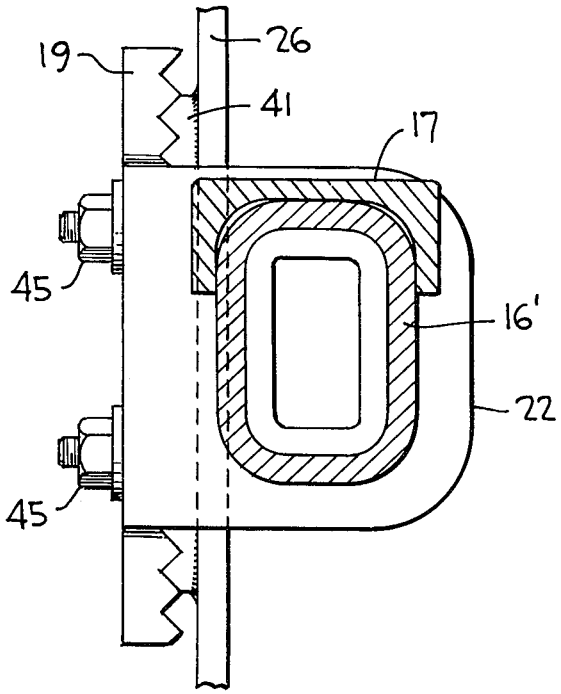
FIG. 8 is an end elevational view of the bracket assembly of FIG. 7.

Another embodiment of a carrier bracket assembly is shown in FIG. 7 which is similar to the aforedescribed embodiment except that carrier brackets 18 and 19 are provided with toothed serrations 37 and 38 on the rearward surfaces thereof so as to intermesh with the teeth of respective lock plates 39 and 41 which are fixedly secured as by welding to side plates 26 and 27. Coupler carrier 16' may be made symmetrical in cross-section (see FIG. 8) thereby allowing inversion of the entire assemlby, i.e., brackets 18, 19 and coupler carrier 16, so as to effect a fine adjustment thereof similarly as described with reference to FIG. 5. For such purpose, wear plate 17 may simply be removed before inversion of the assembly and thereafter set in place similarly as shown in FIGS. 7 and 8. With such arrangement any possibility of misalignment between the bracket teeth and the lock plate teeth is avoided since, if the carrier member is not perfectly parallel to the teeth of the lock plates when installed thereagainst, the bracket teeth and lock plate teeth will not intermesh.

In addition to the advantages heretofore mentioned, the bolted bracket assembly according to the invention contributes to the structural strength of the draft sill arrangement after the assembly is adjusted and securely retained in its locked position. Wreck repairs are facilitated with the present assembly which results in a rail car as strong and as functional as before. Out-of-position welding, as now practiced, is not necessary with this invention thereby resulting in greater reliability. Moreover, provision of a simple and effective arrangement for adjusting the coupler height should result in a closer maintenance of railway car couplers thereby resulting in fewer derailments.

Obviously, many modifications and variations of the present invention are possible in the light of the above teachings. It is therefore to be understood that within the scope of the appended claims the invention may be practiced otherwise than as specifically described.

What is claimed is:

1. In a rail car with a coupler having its shank resting on a coupler carrier member and brackets supporting said carrier member, said brackets being mounted on side plates of the rail car, the improvement comprising each of said brackets having a serrated surface of horizontally disposed teeth of a predetermined size, pairs of vertically spaced bolts for respectively mounting said brackets in place, said brackets having pairs of vertically spaced and vertically elongated openings therein through which said bolts extend, lock plates for vertically adjusting said brackets, each of said lock plates having a serrated surface of horizontally disposed teeth of a size equal to said bracket teeth size, said lock plates having pairs of vertically spaced openings therein through which said bolts respectively extend, one of said lock plate openings having its axis intersecting with an apex of one of said lock plate teeth, and the other of said lock plate openings having its axis intersecting with a trough between a pair of adjacent teeth, said lock plate teeth intermeshing with said bracket teeth, and means engaging said bolts for retaining said brackets mounted in place, said lock plates each being disposed in a first position in which said one opening axis intersects with a trough between adjacent teeth of said brackets and in which said other opening axis intersects with a tooth apex of said brackets whereby said brackets may be disposed at a first elevation and may be vertically adjustable to a second elevation spaced from said first elevation at a distance equal to the size of at least one of said teeth, and said lock plates each being disposable in a second position inverted relative to said first position in which said one opening axis intersects with said tooth apex of said brackets while said other opening axis intersects with said trough between said adjacent teeth of said brackets whereby said brackets may be disposed at an elevation intermediate said first and second elevations and spaced therefrom a distance equal to the size of at least ½ one of said teeth.

2. In a rail car including a coupler having a shank, spaced side plates on the rail car, brackets on said side plates and a horizontal carrier member supported on said brackets, said coupler extending outwardly of said side plates with its shank resting on said carrier member, the improvement comprising each of said brackets having serrated surfaces on one face thereof, a plurality of teeth of a predetermined size lying parallel to said carrier member and comprising said serrated surfaces, at least a pair of vertically spaced and vertically elongated openings in said brackets, bolts extending through said side plates and said openings, and lock plates provided for effecting vertical adjustment of said brackets relative to said side plates, said lock plates having serrations on one surface thereof comprising a plurality of teeth of a size equal to said bracket teeth size and parallel thereto, at least a pair of vertically spaced openings in said lock plates through which said bolts extend, said lock plate serrations intermeshing with said bracket serrations in a first position of said lock plates whereby said brackets are vertically adjustable by an amount equal to at least the size of one of said teeth, the axis of one of said openings in said lock plates intersecting with the apex of one of said lock plate teeth while the axis of the other of said lock plate openings intersects with the trough between an adjacent pair of said lock plate teeth, and said lock plate serrations intermeshing with said bracket serrations in a second position of said lock plates inverted 180° from said first position thereof, whereby said brackets are vertically adjustable by an amount equal to at least ½ the size of one of said teeth.

3. In the rail car according to claim 2, wherein said one face of said brackets comprises an outer face thereof, an inner face of said brackets lying against said side plates of the rail car.

4. In the rail car according to claim 2, wherein means are provided engaging said bolt members for retaining said brackets in the vertically adjustable position.

5. A bracket assembly for use with a rail car coupler comprising, a bracket member for supporting one end of a carrier member adapted for support of the coupler, said bracket member being mountable on a side plate of the rail car by means of at least a pair of vertically spaced elongated elements respectively extending through vertically spaced and vertically elongated openings provided in said bracket member, a surface of said bracket member lying perpendicular to the axis of said elements, having toothed serrations thereon of a predetermined tooth size lying in a common direction, a lock plate having toothed serrations on a surface thereof and being of a tooth size equal to said bracket member tooth size, at least a pair of vertically spaced openings in said lock plate through which said elongated elements extend, the axes of said lock plate openings respectively intersecting with the apex of one of the teeth of said lock plate serrations and with the trough between a pair of adjacent teeth of said lock plate serrations, said lock plate serrations and said bracket serrations being intermeshed whereby said bracket member is capable of being shifted upon relative movement thereof, in a direction perpendicular to the direction along which said toothed serrations lie, by an amount equal to at least the size of one of the teeth of said serrations while said lock plate is disposed in a first position to said bracket member, and said bracket member being shiftable upon relative movment thereof in said perpendicular direction by an amount equal to at least ½ the size of said one tooth while said lock plate is disposed in a second position inverted 180° from said first position relative to said bracket member, and means engaging said elongated elements for retaining said bracket member and said lock plate together.

6. The bracket assembly according to claim 5, wherein said elongated elements comprise threaded bolts and said engaging means comprise nuts threadedly engaged with said bolts.

* * * * *